United States Patent [19]

Tajima

[11] Patent Number: 4,513,672

[45] Date of Patent: Apr. 30, 1985

[54] EMBROIDERY SEWING MACHINE

[75] Inventor: Ikuo Tajima, Nagoya, Japan

[73] Assignee: Tokai Industrial Sewing Machine Co., Ltd., Kasugai, Japan

[21] Appl. No.: 517,839

[22] Filed: Jul. 27, 1983

[30] Foreign Application Priority Data

Nov. 22, 1982 [JP] Japan ..... 57-205281
Nov. 22, 1982 [JP] Japan ..... 57-205282

[51] Int. Cl.[3] ..... D05C 3/02
[52] U.S. Cl. ..... 112/100
[58] Field of Search ..... 112/100, 101, 98, 99

[56] References Cited

U.S. PATENT DOCUMENTS

| | | | |
|---|---|---|---|
| 1,327,348 | 1/1920 | Moffatt | 112/100 |
| 1,327,646 | 1/1920 | Weis | 112/100 |
| 1,707,068 | 3/1929 | Rubel | 112/100 |
| 1,762,479 | 6/1930 | Maier | 112/100 |
| 2,067,340 | 1/1937 | Prazak | 112/100 |
| 2,081,793 | 5/1937 | Cundall et al. | 112/100 |
| 2,699,742 | 1/1955 | Smith | 112/100 |
| 4,438,713 | 3/1984 | Kato | 112/100 |
| 4,461,226 | 7/1984 | Tajima | 112/98 |

*Primary Examiner*—Ronald Feldbaum
*Attorney, Agent, or Firm*—Wenderoth, Lind & Ponack

[57] ABSTRACT

An embroidery sewing machine equipped with a needle bar driving mechanism and a thread take-up mechanism, further comprising a rotating mechanism for a cylinder and bobbin having a cylinder on which is mounted a rotary ring rotatable therewith around a needle and a bobbin which is mounted on the rotary ring rotatable therewith, a device for transmitting the rotation of the first shaft to the cylinder to be rotated accordingly, a cylinder lifting mechanism including a linking means which transmits the up and down lifting motion of an L-shaped arm to the cylinder which inturn is shifted correspondingly through the actuation of an eccentric cam means and a retainer member which is devised to retain the L-shaped arm at a predetermined position by the medium of a supporting arm with which the retainer member is engaged.

5 Claims, 9 Drawing Figures

EMBROIDERY SEWING MACHINE

BACKGROUND AND BRIEF SUMMARY OF THE INVENTION

The present invention relates to an embroidery sewing machine. More specifically the invention relates to a lockstitch embroidery sewing machine wherein a piece of needle thread and a piece of lockstitch bobbin thread join in the formation of lockstitch seams while a cord supplied from the other source is wound with turns of winding thread supplied from a bobbin which is in turn locked by the piece of needle thread during the process of stitch formation.

In a conventional embroidery sewing machine, a rotatable rotary ring equipped with a drive gear on the upper periphery thereof is arranged on a cylinder. A protruding support arm having an extending shaft for mounting a bobbin on which a winding thread is wound is secured fixedly on the periphery of the rotary ring. The shaft for mounting the bobbin thereon is designed to be tilted or slanted outwardly and downwardly with respect to an axis of a needle bar.

While a lockstitch seam is formed by means of a needle thread and a lockstitch bobbin thread, as is well-known to those skilled in the art, the drive gear of the rotary ring is driven by a driving mechanism of a prior art to rotate the rotary ring around the cylinder accompanied by the bobbin mounted on the support arm.

While the bobbin rotates around the cylinder, a piece of winding thread is unwound therefrom while a piece of cord supplied from other source is wound with turns of the piece of winding thread which in turn is locked by the piece of needle thread to form lockstitch embroidery seams.

However, the structure of the rotary ring rotatable arranged around the cylinder brings forth an increase of orbital radius of the rotation when the bobbin mounted on the tilted or slanted shaft of protruding support arm is rotated around the cylinder together with the rotary ring.

Therefore, an operator should always keep away from the rotation radius of the support arm to avoid bumping thereagainst, whereby an effective operation of the machine is hindered. There are also other drawbacks such as untimely and inadvertent unwinding of winding thread from the bobbin when the rotation of rotary ring comes a sudden stop while the bobbin still tends to continue to unwind the thread therefrom due to inertia created by the rotation thereof.

Accordingly, it is an object of this invention to provide a new bobbin and cylinder structure designed for overcoming heretofore mentioned drawbacks.

To replace an embroidery fabrics positioned underneath a cylinder nipple it is necessary to lift the cylinder upward and to keep it at a predetermined raised position in order to keep ample space or room for the replacement of embroidery fabrics. In a conventional embroidery sewing machine, the lifting of the cylinder is usually operated manually.

It is another object of the invention to provide a new lifting device for cylinder which is mechanically operated.

BRIEF DESCRIPTION OF THE DRAWINGS

The accompanying drawings illustrate an embodiment according to the present invention.

DETAILED DESCRIPTION OF THE INVENTION

Figure 1:
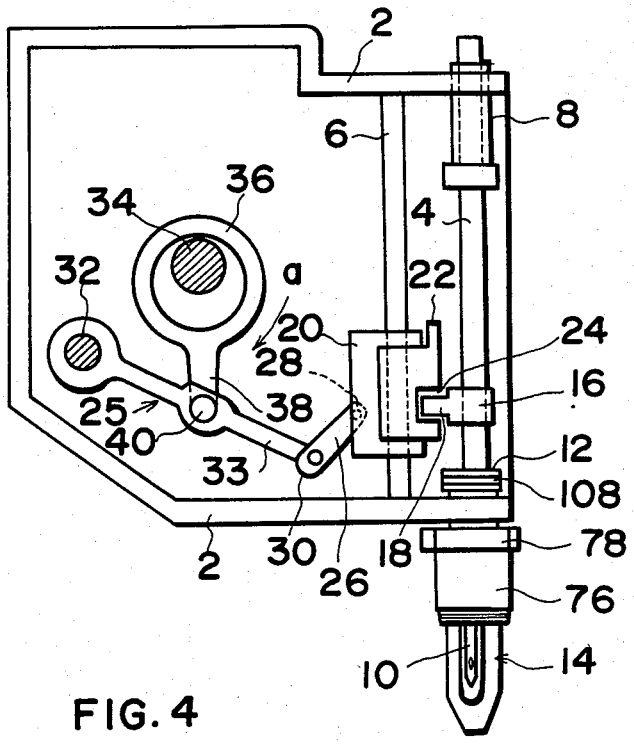
FIG. 1 shows a side view of a needle bar driving mechanism.
Figure 4:
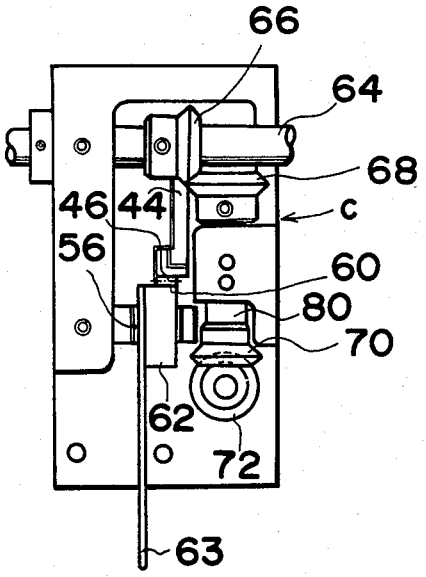
FIG. 4 is a plan view which is seen from the top of FIG. 3.

Now an exemplary embodiment of the present invention is described hereunder with particular reference to the accompanying drawings.

An embroidery sewing machine according to the present invention comprises four components: a needle bar driving mechanism "a", a thread take-up lever driving mechanism "b", a rotating mechanism for a cylinder and bobbin "c", and a cylinder lifting mechanism "d".

The needle bar driving mechanism "a" comprises a needle bar 4 mounted movable up and down in a machine frame 2 and a needle bar driving guide bar 6 mounted fixedly in parallel therewith in the machine frame 2. The upper portion of the needle bar 4 is slidably movable through a bushing 8 mounted in the machine frame 2 while the lower portion thereof equipped with a needle 10 is depending downwardly into a bored hole 89 of a cylinder 14 through a cylinder lifting ring 12 provided on upper end portion of the upper cylinder 90 and is movable up and down through the cylinder 14.

A projection 18 of a needle bar clamp 16 fixedly mounted on the needle bar 4 is engaged with a groove 24 of a needle bar driving block 22 which is slidably supported by the needle bar driving bar 6 by which is also slidably supported a needle driving bracket 20 with which the driving block 22 is engaged.

An end portion 28 of a link piece 26 for a needle bar driver 25 is pivotably fastened to the driving bracket 20, while the other end 30 thereof is also pivotably supported by one end of a crank body 33 the other end of which is rotatably supported by a second shaft 34 which extends through an eccentric cam 36 having a leg 38 which is pivotably fastened to the crank body 33 by means of a screw 40.

When the eccentric cam 36 moves up and down in response to the oscillating motion of the second shaft 34, the crank body 33 together with the link piece 26 moves up and down with the third shaft 32 as an axis whereby the driving bracket 20 pivotably fastened to the link piece 26 slides up and down together with the driving block 22 with both members 20 and 22 being slidably supported by the needle bar driving guide bar 6. Concurrently, the needle bar 4 equipped with the needle bar clamp 16 having the projection 18 which is engaging with the groove 24 of the driving block 22 is lifted up and down through the bushing 8 and the cylinder lifting ring 12.

The first horizontal shaft 42 of the thread take-up lever driving mechanism "b" extends through and in fixed relationship to both one end of a take-up lever driver 44 provided on the other end thereof with a gear 46 and one end of a pendant cam follower 54 which is constructed to form a predetermined angle against the take-up lever driver 44. The cam follower 54 is provided with a rotatable cam roller 52 engageable with an eccentric cam groove 50 defined in a cam plate 48 through which the second shaft 34 extends and to which the shaft is in a fixed relation. On the second horizontal shaft 56 are mounted rotatably therewith both a thread take-up lever driving block 62 and a thread take-up lever 63 fastened thereto, the former having a gear 60 on one end thereof which is meshable with the gear 46 of the take-up lever driver 44. At the tip of the thread take-up lever 63 is defined an eyelet 58 for threading a piece of needle thread $\alpha$.

When the second shaft 34 extending through and in a fixed relation to an eccentric cam 118 having a small diameter portion 118*a* and a large diameter portion 118*b* oscillates up and down, a periphery of the cam portion 118*a* having a small diameter touches slidingly up and down on a follower roller 120 provided at the end of a cam follower 122 of a cylinder lifting mechanism which will be described in detail hereinafter, whereby the cam follower roller 52 slides forward or backward along the eccentric cam groove 50 with the result that the cam follower 54 moves up and down. The oscillating motion of the cam follower 54 permits the take-up lever driver 44 to be rotated upward and downward with the horizontal shaft 42 as an axis. The motion of the take-up lever driver 44 thus explained causes the take-up lever 63 to be rotated upward and downward supported by the second horizontal shaft 56 through the medium of the two gears 46, 60 and the take-up lever driving block 62 whereby the tension adjustment of a piece of needle thread $\alpha$ threaded through an eyelet 58 disposed in the tip of the take-up lever 63 is performed in time-wise relationship to the motion of the needle bar 4.

Actuation of the rotating mechanism for a cylinder and bobbin "c" is initiated by the rotation of the first shaft 64, which is transmitted to a spur gear 78 arranged on the upper end of the rotary ring 76 by the medium of the first bevel gear 66, the second bevel gear 68, the third bevel gear 70, the fourth bebel gear 72, and a spur gear 74. The first shaft 64 extends through and in a fixed relation to the first gear 66 which is meshing with the second gear 68 provided at one end of a horizontal shaft 80 arranged in perpendicular to the first shaft 64, and the third gear 70 provided at the other end of the shaft 80 is also in meshing engagement with the fourth gear 72 provided on the upper end portion of a vertical shaft 82 arranged at right angle to the horizontal shaft 80, and further, the spur gear 74 provided at the lower end of vertical shaft 82 meshes with the spur gear 78 provided on the upper portion of a rotary ring 76.

The cylinder 14 comprises an upper cylinder 90, a nipple 94 fastened to the upper cylinder 90 and the rotary ring 76 mounted on aforementioned two members 90 and 94 rotatable therewith as will be explained hereinafter more in detail.

A bobbin 84 having a cylindrical body 85 is mounted on the periphery of the rotary ring in such a way that it is rotatable with the rotary ring 76 in a predetermined direction by means of an one-way clutch 86 arranged between a cylindrical body 75 of the bobbin 84 and the rotary ring 76. A male screw 96 provided at the upper portion of the nipple 94 is engaged with a female screw 92 provided at the lower inside of the upper cylinder 90 having a bored hole 89 through which the needle bar 4 is shiftable up and down whereby both members 90 and 94 are removably assembled. On the periphery of the lower portion of the rotary ring 76 is mounted an annular member 100 provided with a thread guide 98 for a piece of winding thread. A retaining nut 102 is screwed on the lower portion of the rotary ring 76 underneath the annular member 100.

Figure 3:
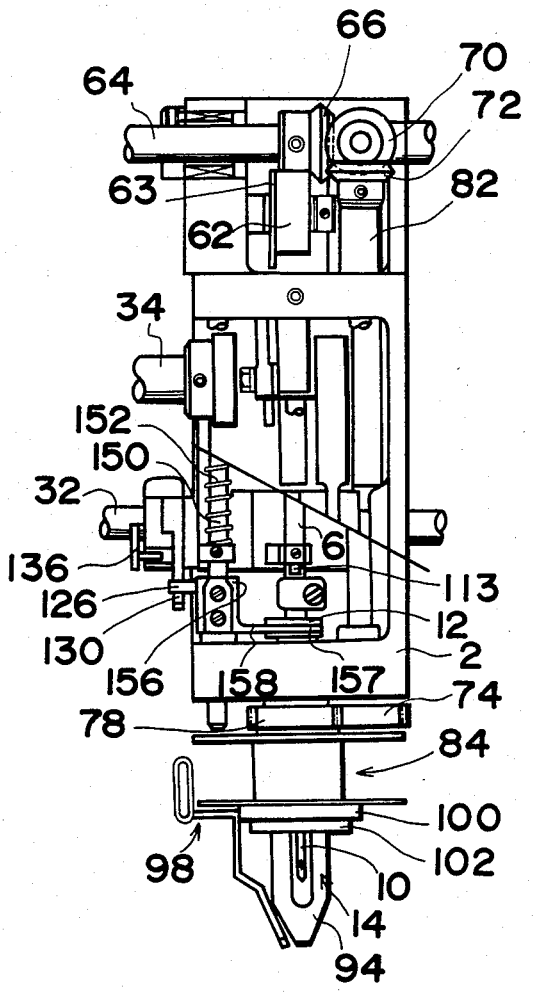
FIG. 3 is a side view of FIG. 2 seen in direction of an arrow A, with a part thereof being eliminated.
Figure 5:
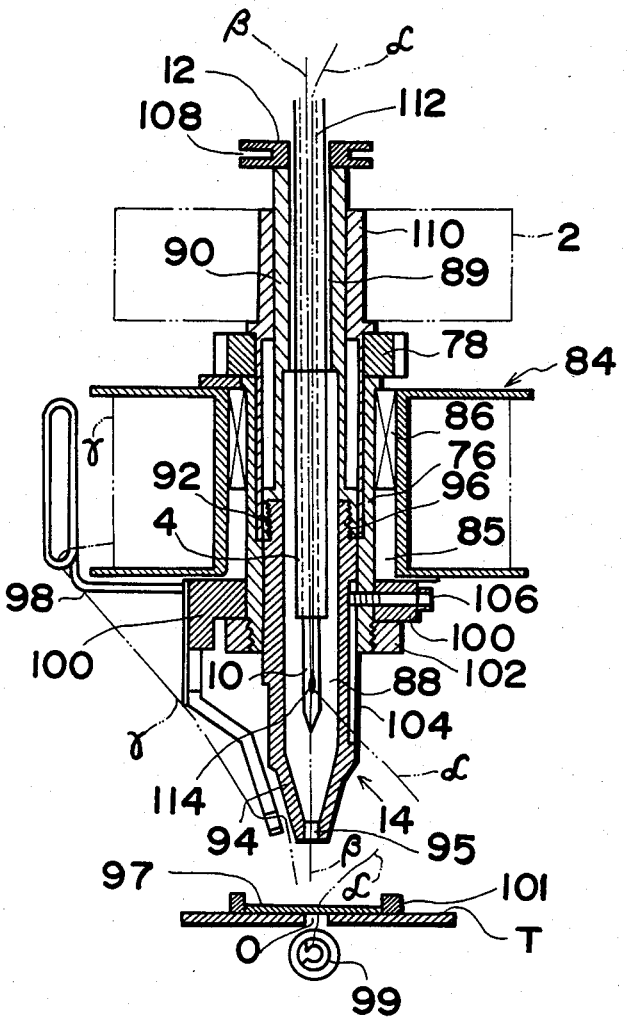
FIG. 5 shows a longitudinal sectional view to an enlarged scale of a cylinder and a bobbin.

In the periphery of the nipple 94 is defined vertical slit 104, and a bolt joint 106 is screwed into the rotary ring 76 through the annular member 100 with the tip thereof reaching onto the vertical slit 104. On the upper end of the upper cylinder 90 is fixedly mounted a cylinder lifting ring 12 having an annular groove 108 defined in the periphery thereof. Numeral 110 represents a retainer sleeve arranged between the machine frame 2 and the upper cylinder 90. Through the needle bar 10 is bored a passage hole 112 into which a piece of needle thread $\alpha$ is supplied through a hole 113 (FIG. 3) to be threaded in a needle hole 114 from the take-up lever 63 and through a thread guide means (not shown). A piece of cord $\beta$ is supplied from a bobbin of a prior art (not shown) through the passage hole 112 into the cavity 88 to be hung down through the nipple hole 95.

When the cylinder lifting ring 12 is lifted up by the actuation of cylinder lifting mechanism "d" which will be explained hereinafter both the upper cylinder 90 and the nipple 94 are shifted upward therewith with the tip of the bolt joint 109 sliding along the vertical slit 104 to permit the upper cylinder 90 and the nipple 94 to be easily shifted up and down in response to the actuation of the cylinder lifting mechanism. Rotaing motion transmitted from the first shaft 64 to the cylinder gear 78 by the medium of four bevel gears 66, 68, 70 and 72 and the spur gear 74 as described heretofore, brings forth a unanimous rotation of the related members in a predetermined direction including the rotary ring 76, the upper cylinder 90, the nipple 94, the annular ring 100, the retainer nut 102 and the bobbin 84 mounted on the outer surface of the rotary ring 76.

The needle bar 4 threaded with a needle thread $\alpha$ through a needle hole 114 moves up and down, by means of aforementioned needle bar driving mechanism "a", through the hole 89 of cylinder 90 and the cavity 88 in the nipple 94, and in unison with the motion of thread take-up lever driving mechanism "b" which controls the tension of a piece of needle thread $\alpha$, the needle 10 is shifted further down into a hook 99 provided underneath a table T through a fabric 97 and a hole 0 to pull up a piece of lockstitch bobbin thread $\alpha'$ from a bobbin located in the hook 99.

Figure 9:
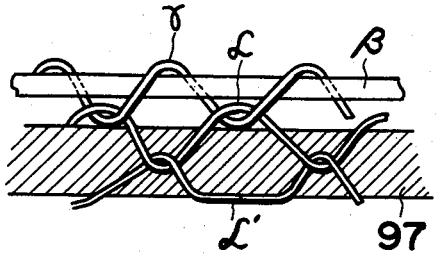
FIG. 9 is a schematic longitudinal sectional view to an enlarged scale of the construction of seams formed by a sewing machine according to the present invention.

In response to an upward or downward motion of the driving mechanism of needle "a", the related members joining in lockstitch formations are shifted up and down accordingly whereby both the piece of needle thread $\alpha$ and the piece of bobbin thread $\alpha'$ are locked with each other to form lockstitch seams in the fabrics 97. While the lockstitch seams are formed by means of two threads $\alpha$ and $\alpha'$, the bobbin 84 on which winding thread $\gamma$ is wound rotates around the needle bar 14 accompanied by the rotary ring 76, the upper cylinder 90, the nipple 94, the thread guide 98 and other related members in a predetermined direction as soon as the rotating motion of the first shaft 64 is transmitted to the rotary ring 76 through related members of the rotating mechanism for a cylinder and a bobbin, as heretofore exaplained, whereby a piece of winding thread $\gamma$ supplied from the rotating bobbin 84 travels around a piece of cord $\beta$ hanging down through the nipple hole 95 and locating underneath thereof, so that the piece of cord $\beta$ may be wound with turns of the piece of winding thread $\gamma$ which is in turn locked by the piece of needle thread $\alpha$ during the process of embroidery stitch formation. The structure of lockstitch embroidery seams thus formed is illustrated in FIG. 9.

The cylinderlifting mechanism "d" is now described hereunder.

The lifting mechanism is so devised to lift the upper cylinder 90 together with the nipple 94, up to a predetermined position and to retain them thereat to provide an ample space while an embroidery frame 101 on which fabrics 97 is mounted is being replaced.

An L-shaped arm 116 comprises the cam follower 122 having a cam follower roller 120 at one end thereof which may contact with a periphery of the eccentric cam 118 through which the second shaft 34 extends and to which said shaft is in a fixed relation and a lift arm 128 having a projection 124 on one end thereof and a pin 126 projecting from the center thereof which may contact with an upper surface of a supporting arm 130. The L-shaped arm 116 is pivotably supported at an intersection of the cam follower 120 and the lift arm 128 both of which are arranged integrally by the third shaft 32. The supporting arm 130 is also pivotably supported by the third shaft 32 at one end thereof and is usually arranged, as described hereinafter, by means of a retainer member 132 which is fixedly mounted on the third shaft 32, to be in contact with the pin 126 projectig from the lift arm 128. A through-hole 134 having a large section 142 is bored through the head of the retainer member 132 in which is also defined a groove 148 in parallel with the through-hole 134. A nut 136 is provided with two legs; that is, a long leg 138 extending through the through-hole 134 and a through-hole 140 arranged in the supporting arm 130 and a short leg 146 slidable into the groove 148. The large section 142 of the through-hole 134 is accomodated therein with a coil spring 144 which is mounting on a part of the long leg 130.

A linking means which transmits lifting motion of the L-shaped arm 116 to the cylinder 14 includes the following members.

A lifting guide bar 150 is shiftably mounted in the frame 2 in parallel with needle bar 4 and the needle bar driving guide bar 6 respectively and had a coil spring 152 mounted around the upper portion thereof. Driving block 156 having a horizontal projection 154 is mounted fixedly on the lifting guide bar 150. To one side of the driving block 156 is fastened an L-shaped connector 158 having a forked finger 157 which engages with an annular groove 108 defined in the periphery of the cylinder lifting ring 12.

Now, the operation of the cylinder lifting mechanism "d" is described hereunder.

Figure 2:
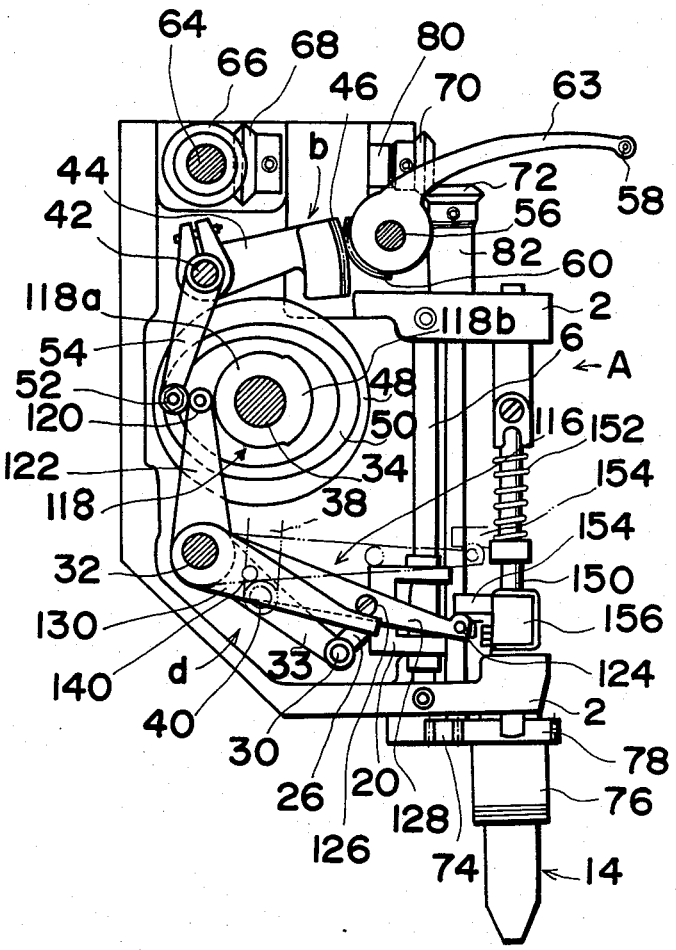
FIG. 2 is a side view of a sewing machine according to the present invention with a bobbin, a thread guide bar and a retainer for a cylinder lifting mechanism being eliminated.
Figure 6:
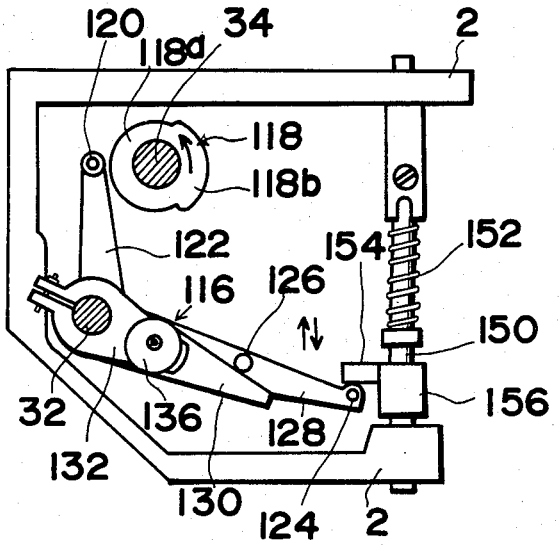
FIG. 6 is a side view of a cylinder lifting mechanism.
Figure 7:
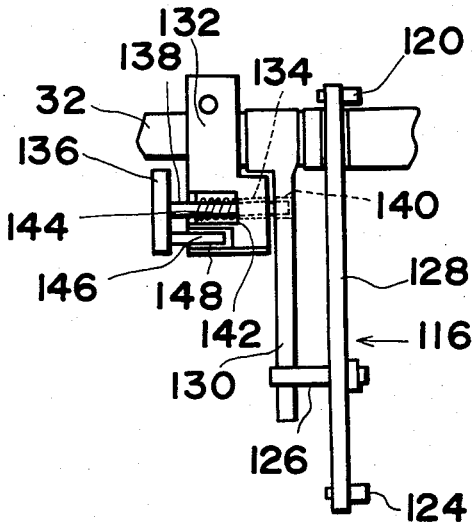
FIG. 7 is a plan view to an enlarged scale of a cylinder lifting mechanism with a lifting guide bar being eliminated.

Firstly, the anti-clockwise rotation of the second shaft 34 as shown in FIG. 6 in the direction of an arrow permits the larger diameter portion **118*b* of the eccentric cam 118 to contact slidingly with the cam follower roller 120 provided at one end of the cam follower 122 of the L-shaped arm 116 whereby the cam follower 122 moves to the left facing to FIG. 2 while the lift arm 128 is lifted upwardly with the third shaft 32 as an axis and push the driving block 156 upward to a predetermined position by the medium of the roller 124 pushing the projection 154 from underneath thereof as will be explained thereinafter. Simultaneously with the rotation of the third shaft 32 the retainer member 132 mounted fixedly thereon rotates to push up the supporting arm 130 by the medium of the longer leg 144 of the nut 136 which extends through both the hole 134 defined in the retainer member 132 and the hole 140 defined in the support arm 130 until the upper surface thereof keeps in touch with the pin 126 provided on the lift arm 128 which is kept at a lifted position with the projection 124 thereof touching under surface of the projection 154 of the driving block 156**.

When the lift arm 128 is lifted corresponding to the touching of the large diameter portion **118*b* of the eccentric cam 118 with the cam follower roller 120 as theretofore explained, the roller 124 arranged on the tip thereof pushes up the driving block 156 together with the lifting guide bar 150 by the medium of horizontal projection 154 against the biasing force of the coil spring 152. Simultaneously, the L-shaped connector 158 fastened to the driving block 156 is lifted upward, thereby the cylinder lifting ring 12 is shifted upward together with the upper cylinder 90 and the nipple 94 by means of the forked fingers 157 engaging with the groove 108 of the lifting ring 12 and is detained at a predetermined position with the supporting arm 130 supporting the lift arm 128 from underneath thereof, as heretofore explained, whereby an ample space between the cylinder nipple 94 and an embroidery frame 101 positioned on the table is maintained so that an operator is able to replace the embroidery frame 101 on which fabrics 97 is mounted. It should be noted that when the upper cylinder 90 and the nipple 94 is lifted upward or downward, the tip of the bolt joint 106 slides along the slit 140 defined in the lower periphery of the nipple 94**.

The explanation now proceeds to the mechanism for releasing the uplifted position of the cylinder 14 whereby the upper cylinder 90, the nipple 94 and other related members are to be restored to the starting positions.

Figure 8:
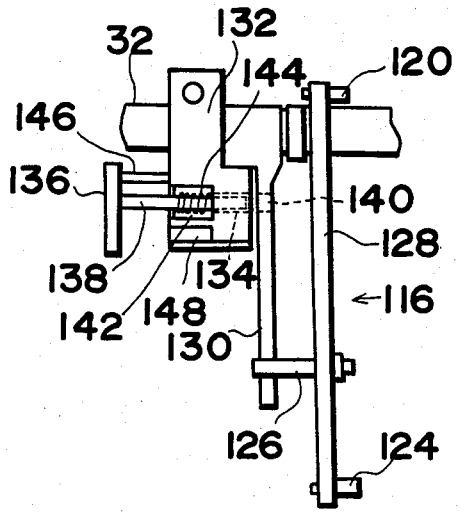
FIG. 8 is a plan view to an enlarged scale wherein a support arm and a retainer are disengaged.

As is shown in FIG. 8, when the nut 136 is pulled to the left facing to FIG. 8 against the biasing force of the coil spring 144, the long leg 138 is pulled out of the hole 140 defined in the support arm 130 thereby the retainer member 132 is disengaged therewith with the support arm 130 being shifted downward while the short leg 146 is pulled out of the groove 148 and by turning the nut 136 counter-clockwise at an angle of about 180°, the position of the short leg 146 is changed accordingly and by releasing the pulling force of the nut 136, the end of the short leg 146 touches onto the side wall of the retainer 132, as shown in FIG. 8. And with the further rotation of the second shaft 34, the smaller diameter portion **118*a* of the eccentric cam 118 rotates to contact slidably with the cam follower roller 120 whereby the cam follower 122 is shifted to the right facing to FIG. 6 simultaneously with a downward shifting of the lift arm 128 with resultant release of the touching engagement of the roller 124 thereof with the projection 154 arranged on the driving block 156 which in turn is shifted downward by the biasing force of the coil spring 152 together with the lifting guide bar 150 which is slidably supported by the frame 2 with the result that the upper cylinder 90 together with the nipple 94 is shifted simultaneously down to their starting position through the medium of the L-shaped connector 158 having the forked fingers 157 engaging with the annular groove 108 defined in the cylinder lifting ring 12 arranged on the top of the upper cylinder 90**.

As heretofore described in detail, the embroidery sewing machine according to the present invention is designed to combine the needle bar driving mechanism, the thread take-up lever driving mechanism, the rotating mechanism for the cylinder and bobbin and the cylinder lifting mechanism, in such a way that an efficient stitch formation of lockstitch embroidery seams may be obtained By using a tape instead of a cord, a tape attaching works can be performed.

The bobbin 84 is mounted on the rotary ring 76 to be rotatable therewith without using any slanted shaft of the protruding support arm on which the bobbin is mounted as was explained in a conventional bobbin structure, whereby an untimely or inadvertent unwinding of thread from the bobbin is prevented and also it is not necessary for an operator to watch out the rotation radius of the support arm to avoid bumping thereagainst.

What we claim is:

1. An embroidery sewing machine having a needle bar driving mechanism and a thread take-up mechanism whereby a piece of needle thread and a piece of lockstitch bobbin thread join in the formation of lockstitch seams comprising:

a rotating mechanism for a cylinder and bobbin having a cylinder and a rotary ring mounted thereon and rotatable therewith around a needle, and a bobbin which is mounted on the rotary ring rotatable therewith, a first shaft, a device for transmitting the rotation of the first shaft to the cylinder to be rotated, a cylinder lifting mechanism including an L-shaped arm and a linking means which transmits the up and down lifting motion of said L-shaped arm to the cylinder and an eccentric cam means for moving said L-shaped arm up and down, and a retainer member and a supporting arm retaining the L-shaped arm at a predetermined position and with which the retainer member is engaged.

2. An embroidery sewing machine comprising;

(a) a rotating mechanism for a cylinder and bobbin having a cylinder (14) comprising an upper cylinder (90), a nipple (94) removably fastened thereto through which a needle (10) equipped with a needle thread $\alpha$ is shiftable up and down by means of the needle bar driving mechanism, while a cord $\beta$ is hunging down therethrough, a rotary ring (76) mounted on the cylinder (14) rotatable therewith, a bobbin on which a winding thread $\gamma$ is wound being mounted on the rotary ring (76) rotatable therewith in a predetermined direstion by means of a one-way clutch (86) arranged between a cylinder body (85) of the bobbin (84) and the rotary ring (76), (b) a rotatable first shaft (64) whose rotating motion is transmitted to a gear (78) arranged on the upper end of the upper cylinder (90) through plural gear means engaging one another in series to rotate the cylinder (14) accompanied by the bobbin (84) and a thread guide bar (98), (c) a cylinder lifting mechanism having a driving block (156) mounted fixedly on a lifting guide bar (150) supported shiftably by a frame 2, to which is fastened an L-shaped connector (158) equipped with forked fingers (157) engaging with an annular groove (108) defined in the cylinder lifting ring (12) of the upper cylinder (90), (d) an L-shaped arm 116 which is pivotably supported by the third shaft (32) including a cam follower (122) having a roller (120) which is engageable alternatively with a large diameter portion (**118*b*) and a small diameter portion (118*a*) of an eccentric cam (118) which is rotatable by means of the second shaft (34), whereby a lift arm (128) may shift the driving block (156) upward or downward accompanied by theliftingguide bar (150) by the medium of a projection (124) thereof which may touch with or detouch from the projection (154) arranged on the driving block (156) corresponding to the alternative engagement of the roller 20 with the two portion (118*b*) and (118*a*) of the eccentric cam (118), (e) a retainer member (132) mounted on the third shaft (32) rotatable therewith and having a nut (136) equipped with a long leg (138) extending therethrough to be shiftable into a hole (140) defined in a supporting arm (130) which is pivotably supported at one end thereof by the third shaft (32), the supporting arm (130) which is engaging with the retainer member (132) with its long leg (138) shifted into the hole (140) being pushed upward to be in contact with a pin (126) projecting from the lift arm (128) corresponding to the rotation of the retainer member (132) supported by the third shaft (32) whereby the lift arm (128**) is retained at a predetermined position.

3. An embroidery sewing machine, as claimed in claim 2, further comprising a rotation mechanism for a cylinder and bobbin permitting the rotation of the first shaft (64) to be transmitted to a spur gear (78) arranged on the upper end periphery of the rotary ring (76), said rotation mechanism comprising the first shaft (64) extending through and in a fixed relation to the first bevel gear (66) which is meshing with the second bevel gear (68) provided at one end of a horizontal shaft (80) in perpendicular to the first shaft (64), the third bevel gear (70) provided at the other end of the shaft (80), which is also in meshing engagement with the fourth bevel gear (72) provided on the upper end portion of a vertical shaft (82) arranged at right angle to the horizontal shaft (80) and a spur gear (74) provided at the lower end of the vertical shaft which is meshing with the spur gear (78) provided on the upper end of a rotary ring (76).

4. An embroidery sewing machine as claimed in 2, wherein a vertical slit (104) is defined in the periphery of the nipple (94) and a bolt joint (106) is screwed into the rotary ring (76) through the annular member (100) with the tip thereof touching onto the vertical slit (104), and with the upward or downward shifting of the nipple (94) by means of the lifting mechanism for cylinder and bobbin, the top of the bolt (106) slides along the slit (140).

5. An embroidery sewing machine, as claimed in 2, in which the retainer member (132) mounted fixedly on the third shaft (32) comprises a through-hole (134) having a large section (142) in which is accommodated a coil spring (144) mounted on a long leg (138), and a groove (148) arranged in parallel with the through-hole (134), and by pulling or releasing a nut (136), the long leg (138) equipped therewith and extending through the through-hole (134) is shiftable in and out of a through-hole (140) defined in the supporting arm (130) while a short leg (146) protruding from the nut (136), is also shiftable in and out of the groove (148), whereby the retainer member (132) may be engaged or disengaged with the supporting arm (130).

* * * * *